US011685967B2

(12) United States Patent
Tho et al.

(10) Patent No.: US 11,685,967 B2
(45) Date of Patent: Jun. 27, 2023

(54) PREPARATION METHOD OF HIGH-STRENGTH AND HIGH-TOUGHNESS A356.2 METAL MATRIX COMPOSITES FOR HUB

(71) Applicants: D. Mag (Kunshan) New Material Technology Co., Ltd, Jiangsu (CN); Giant Light Metal Technology (Haian) Co., Ltd, Jiangsu (CN); Nanjing Tech University, Jiangsu (CN)

(72) Inventors: Kee Ping Tho, Jiangsu (CN); Jinfeng Leng, Shangdong (CN)

(73) Assignees: D. Mag (Kunshan) New Material Technology Co., Ltd, Jiangsu (CN); Giant Light Metal Technology (Haian) Co., Ltd, Jiangsu (CN); Nanjing Tech University, Jiangsu (CN)

( * ) Notice: Subject to any disclaimer, the term of this patent is extended or adjusted under 35 U.S.C. 154(b) by 0 days.

(21) Appl. No.: 17/634,249

(22) PCT Filed: Sep. 29, 2021

(86) PCT No.: PCT/CN2021/121651
§ 371 (c)(1),
(2) Date: Feb. 10, 2022

(87) PCT Pub. No.: WO2022/105453
PCT Pub. Date: May 27, 2022

(65) Prior Publication Data

US 2022/0389539 A1 Dec. 8, 2022

(30) Foreign Application Priority Data

Nov. 17, 2020 (CN) ..... 202011281859.6

(51) Int. Cl.

| | |
|---|---|
| ***C22C 1/03*** | (2006.01) |
| ***C22C 21/02*** | (2006.01) |
| ***C22F 1/043*** | (2006.01) |
| ***B22D 18/00*** | (2006.01) |
| ***C22C 1/02*** | (2006.01) |

(52) U.S. Cl.
CPC ..... *C22C 1/03* (2013.01); *B22D 18/00* (2013.01); *C22C 1/026* (2013.01); *C22C 21/02* (2013.01); *C22F 1/043* (2013.01)

(58) Field of Classification Search
None
See application file for complete search history.

(56) References Cited

FOREIGN PATENT DOCUMENTS

| | | |
|---|---|---|
| CN | 103146961 | 6/2013 |
| CN | 107034380 | 8/2017 |

(Continued)

OTHER PUBLICATIONS

"International Search Report (Form PCT/ISA/210)" of PCT/CN2021/121651, dated Dec. 29, 2021, pp. 1-4.

(Continued)

*Primary Examiner* — George Wyszomierski
*Assistant Examiner* — Janell C Morillo
(74) *Attorney, Agent, or Firm* — JCIRPNET

(57) ABSTRACT

A preparation method of a high-strength and high-toughness A356.2 metal matrix composites for a hub is provided, including the following preparation process steps: preparation of a (graphene+$HfB_2$)-aluminum master alloy wire; A356.2 alloy melting, master alloy addition, refining, and pressure casting; solution and aging treatment; shot blasting, finishing, alkaline/acid cleaning, anodic oxidation, and finished product packaging. In this way, two systems of two-dimensional nano-structure graphene nucleation and in-situ self-nucleation are introduced to complement each other, a second phase of silicon in A356.2 is refined by multi-dimensional scaling, and multi-dimensional nano-phases (Continued)

strengthen the aluminum-based composite material simultaneously. The preparation method solves the problems of limiting the strength, hardness, plasticity and toughness during the application of common A356.2 alloys for a hub, and a graphene/$HfB_2$/aluminum composite material produced by a low-pressure casting process has an excellent comprehensive performance, so as to achieve a further weight reduction requirement for light weight.

4 Claims, 1 Drawing Sheet

(56) References Cited

FOREIGN PATENT DOCUMENTS

| | | | | |
|---|---|---|---|---|
| CN | 108315576 | | 7/2018 | |
| CN | 108396168 | | 8/2018 | |
| CN | 108950321 | A * | 12/2018 | ..... C22C 1/1036 |
| CN | 109112367 | | 1/2019 | |
| CN | 109136674 | | 1/2019 | |
| CN | 111041287 | | 4/2020 | |
| CN | 111074104 | | 4/2020 | |
| CN | 111118329 | | 5/2020 | |
| CN | 111575549 | | 8/2020 | |
| CN | 112095031 | | 12/2020 | |
| CN | 112126808 | A * | 12/2020 | |
| CN | 109161735 | | 2/2021 | |
| PL | 425041 | | 10/2019 | |

OTHER PUBLICATIONS

"Written Opinion of the International Searching Authority (Form PCT/ISA/237)" of PCT/CN2021/121651, dated Dec. 29, 2021, pp. 1-5.

* cited by examiner

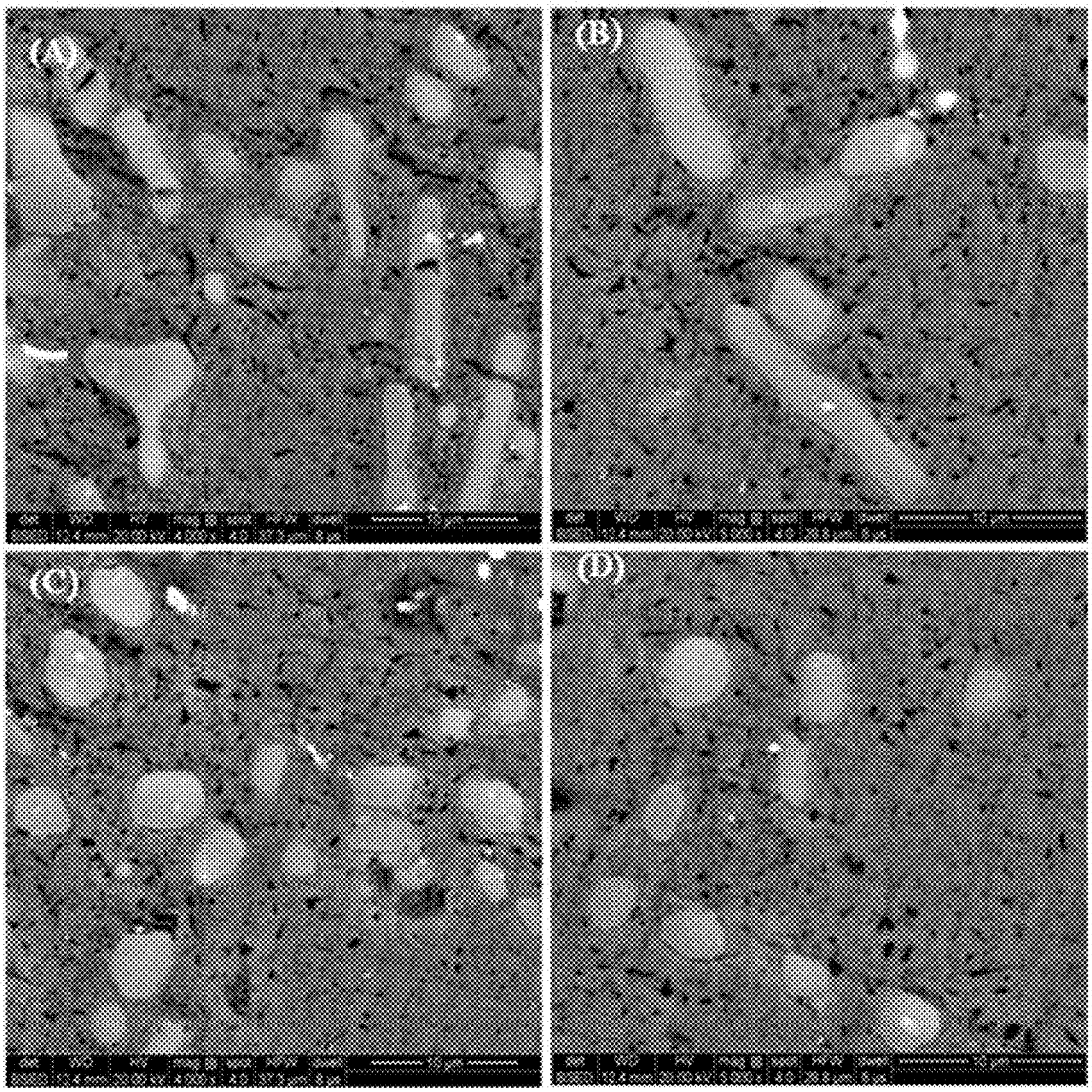
(A)
(B)
(C)
(D)

PREPARATION METHOD OF HIGH-STRENGTH AND HIGH-TOUGHNESS A356.2 METAL MATRIX COMPOSITES FOR HUB

CROSS-REFERENCE TO RELATED APPLICATION

This application is a 371 of international application of PCT application serial no. PCT/CN2021/121651, filed on Sep. 29, 2021, which claims the priority benefit of China application no. 202011281859.6, filed on Nov. 17, 2020. The entirety of each of the above mentioned patent applications is hereby incorporated by reference herein and made a part of this specification.

TECHNICAL FIELD

The present disclosure relates to a high-strength and high-toughness A356.2 metal matrix composites for a hub, and in particular, to a preparation method of a high-strength and high-toughness A356.2 aluminum-based composite material for a hub.

DESCRIPTION OF RELATED ART

A representative Al—Si hypoeutectic alloy in cast aluminum alloys, which has received wide attention for excellent properties, is A356.2, which is a cast aluminum alloy developed and applied by the United States at first.

By adding various modifiers to A356 alloys to improve the morphology and distribution of phases in the alloys, the change of the morphology of modified alloy phases results in a certain degree of performance improvement. The researches show that sodium salt as an initial modifier for Al—Si alloys has achieved a good modification effect, making a coarse plate-like silicon phase become more regular short rod-like. Sodium salt modification essentially fundamentally changes an original growth mode of the silicon phase, but sodium salt modification also shows many problems such as alloy composition segregation and low absorptivity. Sr, Sb and rare earth modifiers are gradually applied to Al—Si alloys, which solve some problems such as easy regression and instability caused by sodium salt modification, and good morphology distribution is also present in a micro-structure of the alloy after modification. For example, CN103146961A discloses an alloy ingot for an automobile hub and a production method thereof. According to the method, Al—Sr alloy elements are added to a standing furnace, which is beneficial to improve the modification effect on grains of cast products and obtain better mechanical properties. CN108315576A discloses a high-efficiency modifier for an A356 aluminum alloy and a preparation method thereof. The present disclosure designs an Al—Nd—Mg—Sb modifier for an Al—Si—Mg hypoeutectic aluminum alloy. After a correct modification process, the modification effect is better than that of Al-10Sr, and the improvement of an alloy structure also improves the mechanical properties of aluminum alloys. However, Sr and Sb modified Al—Si alloys increase a large number of pinhole defects, resulting in loose structure and low mechanical properties, increasing the difficulty of casting process control and reducing the product yield.

The emergence of graphene nano-phases with sp2 hybridized two-dimensional structure makes many researchers try to use graphene as reinforcements of aluminum-based composite materials, but the poor wettability between graphene and aluminum and the problem of nano-scale make it difficult to add the nano-phases, and also, it is difficult to solve the problem of uniform dispersion, so that the material strength is not significantly improved. According to Patent application No. 201810492475.5: Preparation Method of High-strength and High-conductivity Creep-resistant Graphene-reinforced Aluminum Alloy Material, graphene dispersion liquid is added to a mixture of aluminum powder and an organic solvent, and semi-solid extrusion is performed for pyrolysis to remove organic matters. There are problems that the process is complicated and the production cost is high, and the preparation process and application background of the material are completely different from those of the present patent. According to China Patent Application No. 201810952973.3: Graphene-reinforced Al—Si—Mg Cast Aluminum Alloy and Preparation Method thereof, Patent Application No. 201911292058.7: Graphene-reinforced Al—Si Cast Aluminum Alloy and Preparation Method thereof, and Patent Application No. 202010460438.3: Graphene-reinforced Hypereutectic Al—Si Alloy and Preparation Method thereof, graphene and metal are simply mixed and smelted, the poor wettability of graphene/aluminum would lead to difficulty in achieving ideal effects, and no significant refinement of silicon phases is observed in the patent, the minimum average size is several tens of microns while the maximum average size is about one hundred microns, and the tensile strength value is only 150-180 MPa. According to China Patent Application No. 201811331019.9: Graphene Rare Earth Cerium-reinforced Al—Si—Mg Cast Aluminum Alloy and Preparation Method thereof and China Patent Application No. 201811331020.1: Graphene Rare Earth Scandium-synergistically reinforced Al—Si—Mg Cast Aluminum Alloy and Preparation Method thereof, metal particles and graphene particles are directly and simply mixed and smelted, and the problem of poor interfacial wettability between graphene and aluminum is difficult to be solved. Meanwhile, high-purity inert gas is protected for vacuum arc smelting, the production scale is small, the cost is high, the effect of refining silicon phases by graphene is not significant, and the tensile strength index is only 230-250 MPa. With the continuous improvement of automobile lightweight requirements, higher requirements are put forward for the comprehensive performance of materials. Because of the micro-structure characteristics of A356.2 alloys, such as coarse eutectic silicon phases, the mechanical properties of the alloys cannot meet the requirements of high standard components. Multi-dimensional scaling composite materials fundamentally solve the problems in traditional modification methods, such as easy regression, low absorptivity and pinholes caused by air suction, which limit the quality of products.

SUMMARY

In view of the above problems, the present disclosure discloses a preparation method of a high-strength and high-toughness A356.2 metal matrix composites for a hub.

The present disclosure is achieved by the following technical solutions.

A preparation method of a high-strength and high-toughness A356.2 metal matrix composites for a hub includes the following steps.

(1) Charging aluminum ingot into a resistance furnace when a temperature of the resistance furnace is increased to 420° C.;

(2) After the aluminum ingot is completely melted, adding an Al-20Si master alloy under the condition of increasing the temperature to 720-740° C., and holding the temperature of a melt;

(3) Rapidly adding a magnesium ingot into a liquid surface of the melt, performing an electromagnetic stirring until the melt is homogenized, and adding 2-4 kg/ton of chlorine salt and fluorine salt refining agents under an argon atmosphere for refining at 720-740° C.;

(4) Adding an aluminum-graphene-hafnium diboride master alloy after statically holding the temperature for 5 min, and performing a slag-off treatment and a furnace discharging, a content of graphene being 1-5% of a content of aluminum in the aluminum-graphene-hafnium diboride master alloy, and a content of hafnium diboride being 0.3-1% of the content of aluminum in the aluminum-graphene-hafnium diboride master alloy;

(5) Performing a pressure casting at 690-720° C.;

(6) Performing a solution and aging heat treatment process;

(7) Performing a shot blasting, a mechanical finishing, an alkaline cleaning, an acid cleaning, a surface anodic oxidation, and a finished product packaging.

The high-strength and high-toughness A356.2 metal matrix composites for the hub is composed of the following alloy in mass percentage: 6.5-7.5% of Si, 0.30-0.45% of Mg, 0.01-0.08% of Cu, 0.03-0.15% of graphene, 0.01-0.05% of $HfB_2$, not more than 0.1% of Ti, not more than 0.1% of Fe, not more than 0.05% of Mn, and the balance of Al.

Preferably, a preparation method of the aluminum-graphene-hafnium diboride master alloy in step (4) is: adding an aluminum-10% hafnium master alloy into an aluminum melt of 740-760° C., then adding an aluminum-5% boron master alloy and an aluminum-10% graphene master alloy, and continuously casting and continuously rolling to produce a master alloy with a diameter of 9.5 mm.

Preferably, graphene in step (4) is 1-5 layers of graphene with a particle size of 1-15 μm.

Preferably, in step (5), a pressure in the pressure casting is divided into a boost pressure and a mold-filling pressure, the boost pressure is 0.3-0.6 kPa, a boost time is 2-5 s, the mold-filling pressure is 10-20 kPa, a mold-filling time is 5-10 s, a mold-holding time is 200-400 s, and a casting mold temperature during the pressure casting is 260-360° C.

Preferably, in step (6), specific operations of the solution and aging heat treatment process are: performing a solution at a temperature of 535° C. for 4-6 h, performing a water quenching at a temperature of 40-60° C. for 3-5 min, performing an aging at a temperature of 170-190° C., holding the temperature in the aging for 4-8 h, and performing an air cooling.

Beneficial Effects

The present disclosure discloses a preparation method of a high-strength and high-toughness A356.2 metal matrix composites for a hub. Graphene is added in a specific form into two heterogeneous nucleated nano-phases, namely graphene and $HfB_2$, to act synergistically and jointly refine and spheroidize a silicon phase, so as to improve strength and toughness. Meanwhile, graphene has very high intrinsic strength, which is more than 100 times of steel. $HfB_2$ is a ceramic phase hard particle and also has high intrinsic strength. The two reinforcements can act as alloy skeletons to improve mechanical properties through high intrinsic strength. A strengthening mechanism mainly includes material strengthening achieved by second phase strengthening, dislocation strengthening and fine grain strengthening, and material toughening through grain refinement. The present disclosure discloses a high-strength and high-toughness A356.2 metal matrix composites for a hub. Two systems of two-dimensional nano-structure graphene nucleation and in-situ self-nucleation are introduced to complement each other, a second phase of silicon in A356.2 is refined by multi-dimensional scaling, and multi-dimensional nano-phases strengthen the aluminum-based composite material simultaneously. The preparation process steps are as follows: preparation of a (graphene+$HfB_2$)-aluminum master alloy wire; A356.2 alloy melting, master alloy addition, refining, and low-pressure casting; solution and aging treatment; shot blasting, finishing, alkaline/acid cleaning, and anodic oxidation. In this way, the present disclosure solves the problems of limiting the strength, hardness, plasticity and toughness during the application of common A356.2 alloys for a hub, and graphene/$HfB_2$/Al composites produced by a low-pressure casting process has an excellent comprehensive performance, so as to achieve a further 20% weight reduction requirement for light weight.

BRIEF DESCRIPTION OF THE DRAWINGS

FIGURE is a scanning electron micrograph showing an effect of addition of graphene/$HfB_2$ on refinement of an alloy silicon phase, where (A) and (B) of FIGURE are scanning electron micrographs of an A356.2 metal matrix composites not added with graphene/$HfB_2$, and (C) and (D) of FIGURE are scanning electron micrographs of an A356.2 alloy added with graphene/$HfB_2$.

DESCRIPTION OF THE EMBODIMENTS

Embodiments of the present disclosure are described in detail below. The embodiments are implemented on the premise of the technical solution of the present disclosure. Detailed implementations and specific operation processes are given. However, the protection scope of the present disclosure is not limited to the following embodiments.

Not more than 0.1% of Ti, not more than 0.1% of Fe and not more than 0.05% of Mn refer to the content of allowable impurities in a composite material.

Embodiment 1

A high-strength and high-toughness A356.2 metal matrix composites for a hub is composed of the following alloy in mass percentage: 7.2% of Si, 0.38% of Mg, 0.06% of Cu, 0.15% of graphene, 0.01% of $HfB_2$, not more than 0.1% of Ti, not more than 0.1% of Fe, not more than 0.05% of Mn, and the balance of Al.

A preparation method of a high-strength and high-toughness A356.2 metal matrix composites for a hub includes the following steps.

(1) An aluminum ingot is charged into a resistance furnace when the temperature of the resistance furnace is increased to 420° C.

(2) After the aluminum ingot is completely melted, an Al-20Si master alloy is added under the condition of increasing the temperature to 720° C., and the temperature of a melt is held.

(3) A magnesium ingot is rapidly added below a liquid surface of the aluminum melt, and electromagnetically stirred until the melt is homogenized, and 3 kg/ton of chlorine salt and fluorine salt refining agents are added under an argon atmosphere for refining at 720° C.

(4) An aluminum-graphene-hafnium diboride master alloy is added after statically holding the temperature for 5 min, and slag-off treatment and furnace discharging are performed. The content of graphene is 5% of that of aluminum in the master alloy, and the content of hafnium diboride is 0.3% of that of aluminum in the master alloy.

(5) Low-pressure casting is performed at 700° C. A boost pressure is 0.5 kPa, a boost time is 5 s, a mold-filling pressure is 18 kPa, a mold-filling time is 8 s, a mold-holding time is 400 s, and a casting mold temperature during casting is 260-360° C.

(6) A solution and aging heat treatment process is performed, including: performing solution at a temperature of 535° C. for 5 h, performing water quenching at a temperature of 60° C. for 4 min, performing aging at a temperature of 180° C., holding the temperature for 8 h, and performing air cooling.

(7) Shot blasting, mechanical finishing, alkaline cleaning, acid cleaning, surface anodic oxidation, and finished product packaging are performed.

A preparation method of the aluminum-graphene-hafnium diboride master alloy in step (4) is: adding an aluminum-10% hafnium master alloy into an aluminum melt of 760° C., then adding an aluminum-5% boron master alloy and an aluminum-10% graphene master alloy, and continuously casting and continuously rolling to produce a master alloy wire with a diameter of 9.5 mm. Graphene is 1-3 layers of graphene with a particle size of 1 μm.

Embodiment 2

A high-strength and high-toughness A356.2 metal matrix composites for a hub is composed of the following alloy in mass percentage: 6.5% of Si, 0.30% of Mg, 0.04% of Cu, 0.03% of graphene, 0.01% of $HfB_2$, not more than 0.1% of Ti, not more than 0.1% of Fe, not more than 0.05% of Mn, and the balance of Al.

A preparation method of a high-strength and high-toughness A356.2 metal matrix composites for a hub includes the following steps.

(1) An aluminum ingot is charged into a resistance furnace when the temperature of the resistance furnace is increased to 420° C.

(2) After the aluminum ingot is completely melted, an Al-20Si master alloy is added under the condition of increasing the temperature to 740° C., and the temperature of a melt is held.

(3) A magnesium ingot is rapidly added below a liquid surface of the aluminum melt, and electromagnetically stirred until the melt is homogenized, and 2 kg/ton of chlorine salt and fluorine salt refining agents are added under an argon atmosphere for refining at a refining temperature of 730° C.

(4) An aluminum-graphene-hafnium diboride master alloy is added after statically holding the temperature for 5 min, and slag-off treatment and furnace discharging are performed. The content of graphene is 3% of that of aluminum in the master alloy, and the content of hafnium diboride is 1% of that of aluminum in the master alloy.

(5) Low-pressure casting is performed at 690° C. A boost pressure is 0.4 kPa, a boost time is 3 s, a mold-filling pressure is 12 kPa, a mold-filling time is 10 s, a mold-holding time is 350 s, and a casting mold temperature is 320° C.

(6) A solution and aging heat treatment process is performed, including: performing solution at a temperature of 535° C. for 5 h, performing water quenching at a temperature of 50° C. for 4 min, performing aging at a temperature of 170° C., holding the temperature for 6 h, and performing air cooling.

(7) Shot blasting, mechanical finishing, alkaline cleaning, acid cleaning, surface anodic oxidation, and finished product packaging are performed.

A preparation method of the aluminum-graphene-hafnium diboride master alloy in step (4) is: adding an aluminum-10% hafnium master alloy into an aluminum melt of 760° C., then adding an aluminum-5% boron master alloy and an aluminum-10% graphene master alloy, and continuously casting and continuously rolling to produce a master alloy wire with a diameter of 9.5 mm. Graphene is 5 layers of graphene with a particle size of 15 μm.

Embodiment 3

A high-strength and high-toughness A356.2 aluminum-based composite material for a hub is composed of the following alloy in mass percentage: 7.5% of Si, 0.45% of Mg, 0.08% of Cu, 0.03% of graphene, 0.03% of $HfB_2$, not more than 0.1% of Ti, not more than 0.1% of Fe, not more than 0.05% of Mn, and the balance of Al.

A preparation method of a high-strength and high-toughness A356.2 metal matrix composites for a hub includes the following steps.

(1) An aluminum ingot is charged into a resistance furnace when the temperature of the resistance furnace is increased to 420° C.

(2) After the aluminum ingot is completely melted, an Al-20Si master alloy is added under the condition of increasing the temperature to 720° C., and the temperature of a melt is held.

(3) A magnesium ingot is rapidly added below a liquid surface of the aluminum melt, and electromagnetically stirred until the melt is homogenized, and 4 kg/ton of chlorine salt and fluorine salt refining agents are added under an argon atmosphere for refining at a refining temperature of 720° C.

(4) An aluminum-graphene-hafnium diboride master alloy is added after statically holding the temperature for 5 min, and slag-off treatment and furnace discharging are performed. The content of graphene is 1% of that of aluminum in the master alloy, and the content of hafnium diboride is 1% of that of aluminum in the master alloy.

(5) Low-pressure casting is performed at 690° C. A boost pressure is 0.3 kPa, a boost time is 2 s, a mold-filling pressure is 10 kPa, a mold-filling time is 5 s, a mold-holding time is 200 s, and a casting mold temperature is 360° C.

(6) A solution and aging heat treatment process is performed, including: performing solution at a temperature of 535° C. for 6 h, performing water quenching at a temperature of 60° C. for 5 min, performing aging at a temperature of 190° C., holding the temperature for 4 h, and performing air cooling.

(7) Shot blasting, mechanical finishing, alkaline cleaning, acid cleaning, surface anodic oxidation, and finished product packaging are performed.

A preparation method of the aluminum-graphene-hafnium diboride master alloy in step (4) is: adding an aluminum-10% hafnium master alloy into an aluminum melt of 760° C., then adding an aluminum-5% boron master alloy and an aluminum-10% graphene master alloy, and continuously casting and continuously rolling to produce a master alloy wire with a diameter of 9.5 mm. Graphene is 5 layers of graphene with a particle size of 10 μm.

Embodiment 4

A high-strength and high-toughness A356.2 metal matrix composites for a hub is composed of the following alloy in mass percentage: 7.0% of Si, 0.35% of Mg, 0.06% of Cu, 0.07% of graphene, 0.02% of $HfB_2$, not more than 0.1% of Ti, not more than 0.1% of Fe, not more than 0.05% of Mn, and the balance of Al.

A preparation method of a high-strength and high-toughness A356.2 metal matrix composites for a hub includes the following steps.

(1) An aluminum ingot is charged into a resistance furnace when the temperature of the resistance furnace is increased to 420° C.

(2) After the aluminum ingot is completely melted, an Al-20Si master alloy is added under the condition of increasing the temperature to 730° C., and the temperature of a melt is held.

(3) A magnesium ingot is rapidly added below a liquid surface of the aluminum melt, and electromagnetically stirred until the melt is homogenized, and 4 kg/ton of chlorine salt and fluorine salt refining agents are added under an argon atmosphere for refining at 740° C.

(4) An aluminum-graphene-hafnium diboride master alloy is added after statically holding the temperature for 5 min, and slag-off treatment and furnace discharging are performed. The content of graphene is 2.1% of that of aluminum in the master alloy, and the content of hafnium diboride is 0.6% of that of aluminum in the master alloy.

(5) Low-pressure casting is performed at 710° C. A boost pressure is 0.5 kPa, a boost time is 5 s, a mold-filling pressure is 15 kPa, a mold-filling time is 8 s, a mold-holding time is 400 s, and a casting mold temperature is 260° C.

(6) A solution and aging heat treatment process is performed, including: performing solution at a temperature of 535° C. for 4 h, performing water quenching at a temperature of 50° C. for 5 min, performing aging at a temperature of 180° C., holding the temperature for 4 h, and performing air cooling.

(7) Shot blasting, mechanical finishing, alkaline cleaning, acid cleaning, surface anodic oxidation, and finished product packaging are performed.

A preparation method of the aluminum-graphene-hafnium diboride master alloy in step (4) is: adding an aluminum-10% hafnium master alloy into an aluminum melt of 760° C., then adding an aluminum-5% boron master alloy and an aluminum-10% graphene master alloy, and continuously casting and continuously rolling to produce a master alloy wire with a diameter of 9.5 mm. Graphene is 5 layers of graphene with a particle size of 10 μm.

Comparative Example 1

A high-strength and high-toughness A356.2 metal matrix composites for a hub is composed of the following alloy in mass percentage: 7.0% of Si, 0.35% of Mg, 0.06% of Cu, 0.07% of graphene, 0.02% of $HfB_2$, not more than 0.1% of Ti, not more than 0.1% of Fe, not more than 0.05% of Mn, and the balance of Al.

A preparation method of a high-strength and high-toughness A356.2 aluminum-based composite material for a hub includes the following steps.

(1) An aluminum ingot is charged into a resistance furnace when the temperature of the resistance furnace is increased to 420° C.

(2) After the aluminum ingot is completely melted, an Al-20Si master alloy is added under the condition of increasing the temperature to 740° C., and the temperature of a melt is held.

(3) A magnesium ingot is rapidly added below a liquid surface of the aluminum melt, and electromagnetically stirred until the melt is homogenized, and 4 kg/ton of chlorine salt and fluorine salt refining agents are added under an argon atmosphere for refining at a refining temperature of 740° C.

(4) After statically holding the temperature for 5 min, direct stirring is performed, and graphene powder with a particle size of 15 μm and $HfB_2$ powder of 3 μm are added.

(5) Low-pressure casting is performed at 710° C. A boost pressure is 0.5 kPa, a boost time is 2-5 s, a mold-filling pressure is 20 kPa, a mold-filling time is 10 s, a mold-holding time is 350 s, and a casting mold temperature is 300° C.

(6) A solution and aging heat treatment process is performed, including: performing solution at a temperature of 535° C. for 4 h, performing water quenching at a temperature of 50° C. for 5 min, performing aging at a temperature of 180° C., holding the temperature for 4 h, and performing air cooling.

(7) Shot blasting, mechanical finishing, alkaline cleaning, acid cleaning, surface anodic oxidation, and finished product packaging are performed.

Graphene is 5 layers of graphene with a particle size of 10 μm.

Comparative Example 2

A high-strength and high-toughness A356.2 metal matrix composites for a hub is composed of the following alloy in mass percentage: 7.0% of Si, 0.35% of Mg, 0.05% of Cu, 0.08% of graphene, 0.02% of $HfB_2$, not more than 0.1% of Ti, not more than 0.1% of Fe, not more than 0.05% of Mn, and the balance of Al.

A preparation method of a high-strength and high-toughness A356.2 metal matrix composites for a hub includes the following steps.

(1) An aluminum ingot is charged into a resistance furnace when the temperature of the resistance furnace is increased to 420° C.

(2) After the aluminum ingot is completely melted, an Al-20Si master alloy is added under the condition of increasing the temperature to 720° C., and the temperature of a melt is held.

(3) A magnesium ingot is rapidly added below a liquid surface of the aluminum melt, and electromagnetically stirred until the melt is homogenized, and 3 kg/ton of chlorine salt and fluorine salt refining agents are added under an argon atmosphere for refining at a refining temperature of 720° C.

(4) After statically holding the temperature for 5 min, an aluminum-10% graphene master alloy and $HfB_2$ powder with a particle size of 3 μm are added, and slag-off treatment and furnace discharging are performed.

(5) Low-pressure casting is performed at 690° C. A boost pressure is 0.3 kPa, a boost time is 2 s, a mold-filling pressure is 15 kPa, a mold-filling time is 5 s, a mold-holding time is 200 s, and a casting mold temperature is 300° C.

(6) A solution and aging heat treatment process is performed, including: performing solution at a temperature of 535° C. for 6 h, performing water quenching at a temperature of 60° C. for 5 min, performing aging at a temperature of 190° C., holding the temperature for 4 h, and performing air cooling.

(7) Shot blasting, mechanical finishing, alkaline cleaning, acid cleaning, surface anodic oxidation, and finished product packaging are performed.

Graphene is 1-3 layers of graphene with a particle size of 12 μm.

Comparative Example 3

A high-strength and high-toughness A356.2 metal matrix composites for a hub is composed of the following alloy in mass percentage: 7.0% of Si, 0.35% of Mg, 0.02% of Cu, 0.10% of graphene, 0.02% of $HfB_2$, not more than 0.1% of Ti, not more than 0.1% of Fe, not more than 0.05% of Mn, and the balance of Al.

A preparation method of a high-strength and high-toughness A356.2 metal matrix composites for a hub includes the following steps.

(1) An aluminum ingot is charged into a resistance furnace when the temperature of the resistance furnace is increased to 420° C.

(2) After the aluminum ingot is completely melted, an Al-20Si master alloy is added under the condition of increasing the temperature to 740° C., and the temperature of a melt is held.

(3) A magnesium ingot is rapidly added below a liquid surface of the aluminum melt, and electromagnetically stirred until the melt is homogenized, and 4 kg/ton of chlorine salt and fluorine salt refining agents are added under an argon atmosphere for refining at a refining temperature of 730° C.

(4) An aluminum-graphene-hafnium diboride master alloy is added after statically holding the temperature for 5 min, and slag-off treatment and furnace discharging are performed. The content of graphene is 5% of that of aluminum in the master alloy, and the content of hafnium diboride is 1% of that of aluminum in the master alloy.

(5) Low-pressure casting is performed at 720° C. A boost pressure is 0.4 kPa, a boost time is 3 s, a mold-filling pressure is 12 kPa, a mold-filling time is 10 s, a mold-holding time is 350 s, and a casting mold temperature is 300° C.

(6) A solution and aging heat treatment process is performed, including: performing solution at a temperature of 535° C. for 5 h, performing water quenching at a temperature of 50° C. for 4 min, performing aging at a temperature of 170° C., holding the temperature for 6 h, and performing air cooling.

(7) Shot blasting, mechanical finishing, alkaline cleaning, acid cleaning, surface anodic oxidation, and finished product packaging are performed.

A preparation method of the aluminum-graphene-hafnium diboride master alloy in step (4) is: adding an aluminum-10% hafnium master alloy into an aluminum melt of 760° C., and then blowing argon into graphene powder. Graphene is 1-3 layers of graphene with an average particle size of 5 μm.

Comparative Example 4

A high-strength and high-toughness A356.2 metal matrix composites for a hub is composed of the following alloy in mass percentage: 7.2% of Si, 0.38% of Mg, 0.06% of Cu, 0.01% of $HfB_2$, not more than 0.1% of Ti, not more than 0.1% of Fe, not more than 0.05% of Mn, and the balance of Al.

A preparation method of a high-strength and high-toughness A356.2 aluminum-based composite material for a hub includes the following steps.

(1) An aluminum ingot is charged into a resistance furnace when the temperature of the resistance furnace is increased to 420° C.

(2) After the aluminum ingot is completely melted, an Al-20Si master alloy is added under the condition of increasing the temperature to 730° C., and the temperature of a melt is held.

(3) A magnesium ingot is rapidly added below a liquid surface of the aluminum melt, and electromagnetically stirred until the melt is homogenized, and 4 kg/ton of chlorine salt and fluorine salt refining agents are added under an argon atmosphere for refining at a refining temperature of 720° C.

(4) After statically holding the temperature for 5 min, an aluminum-1% hafnium diboride master alloy is added, and slag-off treatment and furnace discharging are performed.

(5) Low-pressure casting is performed at 700° C. A boost pressure is 0.5 kPa, a boost time is 5 s, a mold-filling pressure is 18 kPa, a mold-filling time is 8 s, a mold-holding time is 400 s, and a casting mold temperature is 280° C.

(6) A solution and aging heat treatment process is performed, including: performing solution at a temperature of 535° C. for 5 h, performing water quenching at a temperature of 60° C. for 4 min, performing aging at a temperature of 180° C., holding the temperature for 8 h, and performing air cooling.

(7) Shot blasting, mechanical finishing, alkaline cleaning, acid cleaning, surface anodic oxidation, and finished product packaging are performed.

A preparation method of the aluminum-1% hafnium diboride master alloy in step (4) is: adding an aluminum-10% hafnium master alloy into an aluminum melt of 750° C., and then adding an aluminum-5% boron master alloy. The particle size is 10 μm.

Comparative Example 5

A high-strength and high-toughness A356.2 metal matrix composites for a hub is composed of the following alloy in mass percentage: 7.0% of Si, 0.35% of Mg, 0.06% of Cu, 0.07% of graphene, 0.05% of $HfB_2$, not more than 0.1% of Ti, not more than 0.1% of Fe, not more than 0.05% of Mn, and the balance of Al. The other methods are the same as in Embodiment 4.

Comparative Example 6

A high-strength and high-toughness A356.2 metal matrix composites for a hub is composed of the following alloy in mass percentage: 7.0% of Si, 0.35% of Mg, 0.06% of Cu, 0.07% of graphene, not more than 0.1% of Ti, not more than 0.1% of Fe, not more than 0.05% of Mn, and the balance of Al. The other methods are the same as in Comparative Example 2, and no hafnium diboride is added in step (4).

TABLE 1

Comparison of Mechanical Properties

| Material | Heat Treatment Process | Tensile Strength (MPa) | Yield Strength (MPa) | Elongation (%) |
|---|---|---|---|---|
| Comparative Example 1 | 535° C./5 h 180° C./4 h | 180 | 131 | 1.0% |
| Comparative Example 2 | 535° C./5 h 190° C./8 h | 317 | 234 | 4.0% |
| Comparative Example 3 | 535° C./5 h 170° C./6 h | 150 | 126 | 1.0% |
| Comparative Example 4 | 535° C./6 h 180° C./4 h | 287 | 209 | 3.5% |
| Comparative Example 5 | 535° C./4 h 180° C./4 h | 368 | 309 | 2.5% |
| Comparative Example 6 | 535° C./4 h 190° C./4 h | 305 | 280 | 2.1% |
| Embodiment 1 | 535° C./5 h 180° C./8 h | 320 | 243 | 5.0% |
| Embodiment 2 | 535° C./6 h 170° C./4 h | 342 | 298 | 5.5% |
| Embodiment 3 | 535° C./6 h 190° C./4 h | 365 | 314 | 6.5% |
| Embodiment 4 | 535° C./4 h 180° C./4 h | 386 | 325 | 7.0% |

It will be apparent to those skilled in the art that various modifications and variations can be made in the present disclosure without departing from the spirit and scope of the present disclosure. Thus, if these modifications and variations of the present disclosure fall within the scope of the claims of the present disclosure and equivalent technologies, the present disclosure is also intended to include these modifications and variations.

What is claimed is:

1. A preparation method of a A356.2 metal matrix composite for a hub, comprising the following steps:

step (1) charging an aluminum ingot into a resistance furnace after a temperature of the resistance furnace is increased to 420° C.;

step (2) completely melting the aluminum alloy ingot, increasing the temperature to 720-740° C., adding an Al-20Si master alloy, and holding the temperature of a resulting melt at 720-740° C.;

step (3) adding a magnesium ingot into a liquid surface of the melt, performing an electromagnetic stirring until the melt is homogenized, and adding 2-4 kg/ton of chlorine salt and fluorine salt refining agents under an argon atmosphere for refining at a refining temperature of 720-740° C.;

step (4) adding an aluminum-graphene-hafnium diboride master alloy after statically holding the temperature for 5 min, and performing a slag-off treatment and a furnace discharging, wherein a content of graphene is 1-5% of a content of aluminum in the aluminum-graphene-hafnium diboride master alloy, a content of hafnium diboride is 0.3-1% of the content of aluminum in the aluminum-graphene-hafnium diboride master alloy, and a preparation method of the aluminum-graphene-hafnium diboride master alloy in the step (4) is: adding an aluminum-10% hafnium master alloy into an aluminum melt of 740-760° C., then adding an aluminum-5% boron master alloy and an aluminum-10% graphene master alloy, and continuously casting and continuously rolling to produce an aluminum-graphene-hafnium diboride master alloy wire with a diameter of 9.5 mm;

step (5) performing a pressure casting at a temperature of 690-720° C.;

step (6) performing a solution and aging heat treatment process;

step (7) performing a shot blasting, a mechanical finishing, an alkaline cleaning, an acid cleaning, a surface anodic oxidation, and a finished product packaging, wherein the A356.2 metal matrix composite for the hub is composed of the following alloy in mass percentage: 6.5-7.5% of Si, 0.30-0.45% of Mg, 0.04-0.08% of Cu, 0.03-0.15% of graphene, 0.01-0.05% of $HfB_2$, not more than 0.1% of Ti, not more than 0.1% of Fe, not more than 0.05% of Mn, and the balance of Al.

2. The preparation method according to claim 1, wherein graphene in the step (4) is 1-5 layers of graphene with a particle size of 1-15 μm.

3. The preparation method according to claim 1, wherein in the step (5), a pressure in the pressure casting is divided into a boost pressure and a mold-filling pressure, the boost pressure is 0.3-0.6 kPa, a boost time is 2-5 s, the mold-filling pressure is 10-20 kPa, a mold-filling time is 5-10 s, a mold-holding time is 200-400 s, and a casting mold temperature during the pressure casting is 260-360° C.

4. The preparation method according to claim 1, wherein in the step (6), specific operations of the solution and aging heat treatment process are: performing a solution at a temperature of 535° C. for 4-6 h, performing a water quenching at a temperature of 40-60° C. for 3-5 min, performing an aging at a temperature of 170-190° C., holding the temperature in the aging for 4-8 h, and performing an air cooling.

* * * * *